US007559213B2

(12) United States Patent
Allam et al.

(10) Patent No.: US 7,559,213 B2
(45) Date of Patent: Jul. 14, 2009

(54) PROCESS AND APPARATUS FOR LIQUEFYING HYDROGEN

(75) Inventors: Rodney John Allam, Guildford (GB); Paul Stuart James, Hitchin (GB)

(73) Assignee: Air Products and Chemicals, Inc., Allentown, PA (US)

( * ) Notice: Subject to any disclaimer, the term of this patent is extended or adjusted under 35 U.S.C. 154(b) by 272 days.

(21) Appl. No.: 11/087,053

(22) Filed: Mar. 22, 2005

(65) Prior Publication Data

US 2005/0210914 A1 Sep. 29, 2005

(30) Foreign Application Priority Data

Mar. 24, 2004 (GB) ..... 0406615.5

(51) Int. Cl.
*F25J 1/00* (2006.01)
*F17C 9/02* (2006.01)

(52) U.S. Cl. ..... 62/607; 62/50.2

(58) Field of Classification Search ..... 62/607, 62/606, 50.2, 51.2

See application file for complete search history.

(56) References Cited

U.S. PATENT DOCUMENTS

| | | | | |
|---|---|---|---|---|
| 2,983,585 A | | 5/1961 | Smith | |
| 3,094,390 A | * | 6/1963 | Vander | 423/649 |
| 3,095,274 A | * | 6/1963 | Crawford | 423/649 |
| 3,109,725 A | | 11/1963 | Flynn | |
| 3,347,055 A | | 10/1967 | Blanchard et al. | |
| 3,864,926 A | | 2/1975 | Collins | |
| 4,765,813 A | | 8/1988 | Gaumer, Jr. et al. | |

FOREIGN PATENT DOCUMENTS

| | | |
|---|---|---|
| JP | 04 048184 | 2/1992 |
| JP | 4048184 A | 2/1992 |
| JP | 2002 243360 | 8/2002 |
| JP | 2002-243360 | 8/2002 |
| JP | 2002243360 A | 8/2002 |
| JP | 2003 028567 | 1/2003 |
| JP | 2003028567 A | 1/2003 |

OTHER PUBLICATIONS

Simbeck, et al., "Hydrogen Supply: Cost Estimate for Hydrogen Pathways-Scoping Analysis", National Renewable Energy Laboratory, Nov. 2002.

Quack, H., "Conceptual Design of a High Efficiency Large Capacity Hydrogen Liquefier", CP613, Advances in Cryogenic Engineering: Proceedings of the Cryogenic Engineering Conference, vol. 47, pp. 255-263.

Quack, H., "Conceptual Design of High Efficiency Large Capacity Hydrogen Liquefier", Institute of Physics, New York, NY, US, vol. 47, No. 1, Jul. 16, 2001, pp. 255-263 (XP009033408).

* cited by examiner

*Primary Examiner*—William C Doerrler
(74) *Attorney, Agent, or Firm*—Keith D. Gourley

(57) ABSTRACT

Hydrogen is liquefied by a process comprising pre-cooling hydrogen feed gas by indirect heat exchange against pressurized liquefied natural gas ("LNG") to produce pre-cooled hydrogen feed gas and pressurized natural gas, further cooling at least a portion of said pre-cooled hydrogen feed gas by indirect heat exchange against at least one refrigerant to produce condensable hydrogen gas and expanding at least a portion of said condensable hydrogen gas to produce at least partially condensed hydrogen. One advantage of such a process is that the power consumed during liquefaction is significantly less than that consumed in existing hydrogen liquefaction processes which pre-cool hydrogen feed gas by indirect heat exchange against other refrigerants, e.g. liquid nitrogen.

19 Claims, 1 Drawing Sheet

PROCESS AND APPARATUS FOR LIQUEFYING HYDROGEN

TECHNICAL FIELD OF THE INVENTION

The present invention relates to a process and apparatus for liquefying hydrogen gas.

BACKGROUND OF THE INVENTION

It has been proposed to use hydrogen as a "clean" fuel for vehicles. Such hydrogen-powered vehicles may convert the hydrogen fuel into energy using fuel cells or may use the hydrogen fuel in an internal combustion engine.

Hydrogen fuel may be stored on board the vehicle in the form of high pressure gas (typically 20 to 80 MPa maximum working pressure). However, one serious problem involving the use of high pressure gaseous hydrogen fuel is the risk of a crash causing a rupture of the high pressure hydrogen storage vessel which might result in a sudden explosive pressure wave followed by an immediate deflagration fire.

The alternative to storing hydrogen on board the vehicle in the form of a high pressure gas is to store it in liquid form at low pressure in a cryogenic storage tank. The consequence of rupturing a tank of liquid hydrogen would be the release of hydrogen at low pressure. Such release would result in a fire hazard rather than an explosion risk. Studies have shown that a liquid hydrogen fire is likely to have less severe consequences than a gasoline fire. There are, therefore, clear advantages derivable from storing hydrogen fuel for road vehicles in liquid form rather than as a high pressure gas.

There are two possible methods of delivering hydrogen to fuel outlets. One method involves delivering the hydrogen as a gas in pipelines or in high pressure cylinders transported on road or rail vehicles. The second method involves delivering hydrogen as a liquid carried in insulated tankers. Current technology and road regulations (44 metric tons all-up weight limit in Europe) would allow a payload of about 600 kg of hydrogen as a gas or about 4000 kg of liquid hydrogen. These limits make delivery of hydrogen gas by road a very expensive method compared to the delivery of liquid hydrogen. In this connection, a recent report by the US National Renewable Energy Authority ("Hydrogen Supply: Cost Estimate For Hydrogen Pathways—Scoping Analysis"; D. R. Simbeck and E. Chang, Jul. 2002) gives the total cost (including production, delivery and dispensing) of liquid hydrogen distribution as $3.66/kg compared with $4.39/kg for gaseous hydrogen distribution. These figures are based on using a refrigeration power of 11 kWh/kg. There is, therefore, a clear cost advantage for liquid hydrogen production and delivery when compared with that for gaseous hydrogen. The delivered cost of hydrogen in road vehicles is highly dependent on the delivery distances involved, with the delivered cost of gaseous hydrogen increasing much faster than that for liquid hydrogen.

Projected performance of fuel cell powered cars would indicate that the 4000 kg liquid hydrogen payload would provide approximately the same mileage as the 25 metric ton petrol payload for the current largest petrol tankers used for fuel delivery. Such an amount of liquid hydrogen corresponds with about 200,000 miles of driving for 25 metric tons of petrol assuming an average consumption of about 30 mpg. Various figures have been published for the likely hydrogen consumption of fuel-cell powered vehicles such as cars, SUVs and vans which range from an equivalent energy content of from 50 to 100 mpg. Taking an average of 75 mpg, if liquid hydrogen were used for providing hydrogen fuel to outlets, then it would require about 3.6 metric tons of liquid hydrogen to provide 200,000 miles of driving and the number and type of fuel delivery vehicles would be virtually unchanged compared to current petrol and diesel based fuel systems.

Liquid hydrogen can be raised to a high pressure, e.g. 30 to 80 MPa, using a single stage reciprocating pump followed by heating the pressurized liquid to ambient temperature. This process has lower capital and operating costs that a corresponding hydrogen gas compression system. Therefore, it is also more cost effective to provide pressurized liquid hydrogen as a source of ultra high pressure hydrogen gas at a refueling station for vehicles running on pressurized hydrogen gas.

Large scale production of liquid hydrogen was first carried out in the 1950s as a consequence of the demand for liquid hydrogen as rocket fuel. However, it was quickly apparent that liquid hydrogen could not be used economically as a fuel for road vehicles due to the high power consumption required during hydrogen liquefaction which results in prohibitively high production costs.

The technology of liquid hydrogen production has been under continuous development since the 1950s based on the objective of lower specific power consumption and lower capital costs. For example, current liquefiers have centrifugal expanders and plate fin heat exchangers in place of reciprocating expansion engines and wound coil tubular heat exchangers. In addition, lower pressure hydrogen liquefaction cycles have been developed, together with new ortho-para conversion catalysts. Improvements have been observed by depositing ortho-para conversion catalysts in the feed passages of the heat exchanger and by optimizing the mechanical design layout, control, instrumentation and insulation systems.

Early hydrogen liquefier cycles used hydrogen as the working fluid although, more recently, hydrogen has been replaced with a mixture of gases, for example a mixture of neon and helium, to increase the molecular weight and allow the use of fewer stages of compression and expansion than are required if hydrogen is used as the working fluid. It has also been suggested that evaporating propane or other suitable refrigerants should be used for the first stages of the hydrogen feed cooling.

A hydrogen liquefaction process typically involves two stages; an initial pre-cooling stage and a subsequent liquefaction stage. Hydrogen must be cooled below its upper Joule-Thomson inversion temperature, i.e. the point below which a gas cools when expanded, before it can be liquefied in a recuperative liquefaction cycle. Generally, this means that hydrogen must be cooled below about −150° C. in a pre-cooling step before entering the liquefaction stage of the process.

It is well appreciated in the art that hydrogen gas exists in about 75% ortho form and about 25% para form and that, if hydrogen gas is liquefied without conversion of the ortho form to the para form, then the resultant liquid hydrogen evaporates more easily than liquid hydrogen in predominately the para form. The ortho form of hydrogen gas is, therefore, usually converted catalytically to the para form prior to liquefaction.

In certain known hydrogen liquefaction processes, hydrogen gas is pre-cooled to below about −150° C. by indirect heat exchange against vaporizing liquid nitrogen and/or cold nitrogen gas streams. An example of such a known process is disclosed in U.S. Pat. No. 3,109,725 (Flynn) in which hydrogen gas is pre-cooled by indirect heat exchange against liquid nitrogen in which hydrogen gas is dissolved. A further example is disclosed in U.S. Pat. No. 4,765,813 (Gaumer, Jr. et al) in which hydrogen gas is pre-cooled using liquid nitrogen and then further cooled using a closed neon refrigeration cycle. Compression duty in the refrigeration cycle takes place at the warm end of the cycle.

U.S. Pat. No. 2,983,585 (Smith) discloses a partial oxidation process in which methane is partially oxidized with oxygen to produce carbon monoxide and hydrogen gas. The partial oxidation process is integrated with a hydrogen liquefaction process in which hydrogen gas is pre-cooled by indirect heat exchange against liquid methane and subsequently further cooled against a closed external refrigerating cycle using liquid nitrogen ("LIN") as the refrigerant. The resultant methane is compressed at the warm end of the liquefaction process and then fed to the partial oxidation process. The resultant gaseous nitrogen is compressed at the warm end of the closed cycle before being condensed by indirect heat exchange with liquid methane and recycled. It is disclosed that the liquid methane could be replaced with liquefied natural gas ("LNG").

U.S. Pat. No. 3,347,055 (Blanchard et al) discloses a process in which a gaseous hydrocarbon feedstock is reacted to produce hydrogen gas which is then liquefied in an integrated liquefaction cycle. In one embodiment, the liquefaction cycle involves two closed refrigerant cycles, the first using hydrogen gas a refrigerant and the second using nitrogen. Compression for both refrigeration cycles takes place at the warm end of the cycles. The hydrogen to be liquefied is also cooled by indirect heat exchange against liquefied hydrocarbon feedstock gas thereby producing gaseous feedstock at 1 atm. (e.g. about 0.1 MPa) for use in the hydrogen production plant. It is disclosed that the hydrocarbon feedstock may be natural gas.

JP-A-2002/243360 discloses a process for producing liquid hydrogen in which hydrogen feed gas is pre-cooled by indirect heat exchange against a stream of pressurized LNG. The pre-cooled hydrogen gas is fed to a liquefier where it is further cooled by indirect heat exchange against both LIN and a refrigerant selected from hydrogen or helium. The further cooled hydrogen is then expanded to produce partially condensed hydrogen which is separated into liquid hydrogen, which is removed and stored, and hydrogen vapor which is recycled around the liquefier.

Quack discloses ("Conceptual Design of a High Efficiency Large Capacity Hydrogen Liquefier"; Adv. Cryog. Eng., Proc. CEC, Madison 2001, AIP, Vol. 613, 255-263) a hydrogen liquefier cycle that, to the inventors knowledge, most accurately represents the best current technology projections for hydrogen liquefaction cycles. It should be noted that Quack uses efficiency figures for compressors and turbines that are not achievable at present but which are thought to be realistic for the future.

In the hydrogen liquefaction cycle proposed by Quack, a two stage pre-cooling process is employed. Hydrogen gas at 300K (about 27° C.) and at a pressure of about 8 MPa is cooled to 220K (about −53° C.) by indirect heat exchange against propane as refrigerant. Quack suggests that other refrigerants such as ammonia, fluorocarbons or mixtures of different refrigerants could also be used for this step. The hydrogen gas at 220K (about −53° C.) is then further cooled to about 73K (about −200° C.) by indirect heat exchange against a helium/neon mixture as refrigerant. It is suggested that this vapor compression refrigeration step may use a mixture of refrigerants or gas cycles with nitrogen, hydrogen or helium as refrigerant. The hydrogen gas at 73K (about −200° C.) is then further cooled to 25K (about −248° C.) by indirect heat exchange against a mixture of helium and neon. The further cooled hydrogen gas at 25K (about −248° C.) is then work expanded to partially liquefy the hydrogen. The cycle uses ortho-para conversion catalyst optimally arranged at the cold end of the plant and assumes the usual optimal placement of heat exchangers and turbines in the hydrogen circuit at the cold end of the plant.

Current hydrogen liquefaction processes consume power at a rate of about 11 kWh/kg$_{(liquid\ hydrogen)}$ based on a gaseous hydrogen feed at a typical pressure of 2.5 MPa (25 bar). Quack suggests that the best future power consumption will be in the range 5 to 7 kWh/kg$_{(liquid\ hydrogen)}$ if his suggested improvements are utilised.

One of the major features of the Quack cycle is that all of the main hydrogen compression, propane recycle compression and helium/neon recycle compression takes place with each compressor stage operating at close to ambient temperature using ambient temperature cooling systems to remove heat of compression such as cooling water or air cooling. There is, however, a small cold flash-gas compressor operating at the cold end of the heat exchanger.

Compressors operating at the warm end of a cryogenic cycle are usually cooled using water or air as a coolant.

It is an objective of preferred embodiments of the present invention to reduce power consumption in hydrogen liquefaction processes to such an extent that liquid hydrogen as a vehicle fuel becomes not only a viable economic alternative to gasoline but also the natural choice over pressurized hydrogen gas as the form in which hydrogen is delivered to vehicle refueling stations either by road vehicle or by pipeline.

The low molecular weight of hydrogen means that a very large number of stages of compression must be used if centrifugal compressors are specified and, likewise for a given expansion duty, a large number of centrifugal expansion stages will be required operating in series. In current plants, the hydrogen compressors are often reciprocating units. Multiple stage compressors plus large recuperative heat exchangers will usually be used in the pre-cooling steps of the process.

It is, therefore, also an objective of preferred embodiments of the present invention to reduce the capital cost of hydrogen liquefaction, in particular, by targeting the pre-cooling stage of the process.

LNG is produced and stored in vast quantities in numerous locations around the world. Such storage facilities pressurize and heat LNG before supplying the resultant pressurized natural gas to pipelines for distribution to industry and homes. The inventors have realized that, by using the internal energy of pressurized LNG to provide part of the energy required to liquefy hydrogen, it is possible to efficiently convert this vast source of energy to effective power which appears as a power reduction in a hydrogen liquefaction process. In effect, pressurized LNG absorbs heat at low temperature liberated from a hydrogen liquefaction plant.

At present, LNG storage and distribution facilities pump LNG to high pressure, usually between from about 3 to about 10 MPa, and then heat the pressurized LNG using natural gas burners submerged in a water bath. The burners use a small portion, e.g. 1 to 2%, of the ambient temperature natural gas as a fuel to heat the remaining pressurized LNG to ambient temperature.

It is, therefore, a further objective of preferred embodiments of the present invention to reduce the quantity of pressurized LNG needed to provide the heat required to heat pressurized LNG thereby producing high pressure natural gas for supply to pipelines.

SUMMARY OF THE INVENTION

The present invention provides a process for liquefying hydrogen. The process comprises pre-cooling hydrogen feed gas by indirect heat exchange against pressurized liquefied natural gas ("LNG") to produce pre-cooled hydrogen feed gas and pressurized natural gas. At least a portion of said pre-cooled hydrogen feed gas is further cooled by indirect heat exchange against at least one refrigerant to produce condensable hydrogen feed gas and at least one warmed refrigerant. At least a portion of said condensable hydrogen feed gas is then expanded to produce at least partially condensed hydrogen.

The invention also provides apparatus for liquefying hydrogen according to this process. The apparatus comprises heat exchange means for pre-cooling hydrogen feed gas by indirect heat exchange against pressurized LNG to produce pre-cooled hydrogen feed gas. In addition, the apparatus comprises heat exchange means for further cooling pre-cooled hydrogen feed gas by indirect heat exchange against at least one refrigerant to produce condensable hydrogen feed gas and at least one warmed refrigerant. Further, the apparatus comprises expansion means for expanding condensable hydrogen feed gas to produce at least partially condensed hydrogen.

DETAILED DESCRIPTION OF THE INVENTION

Figure 1:
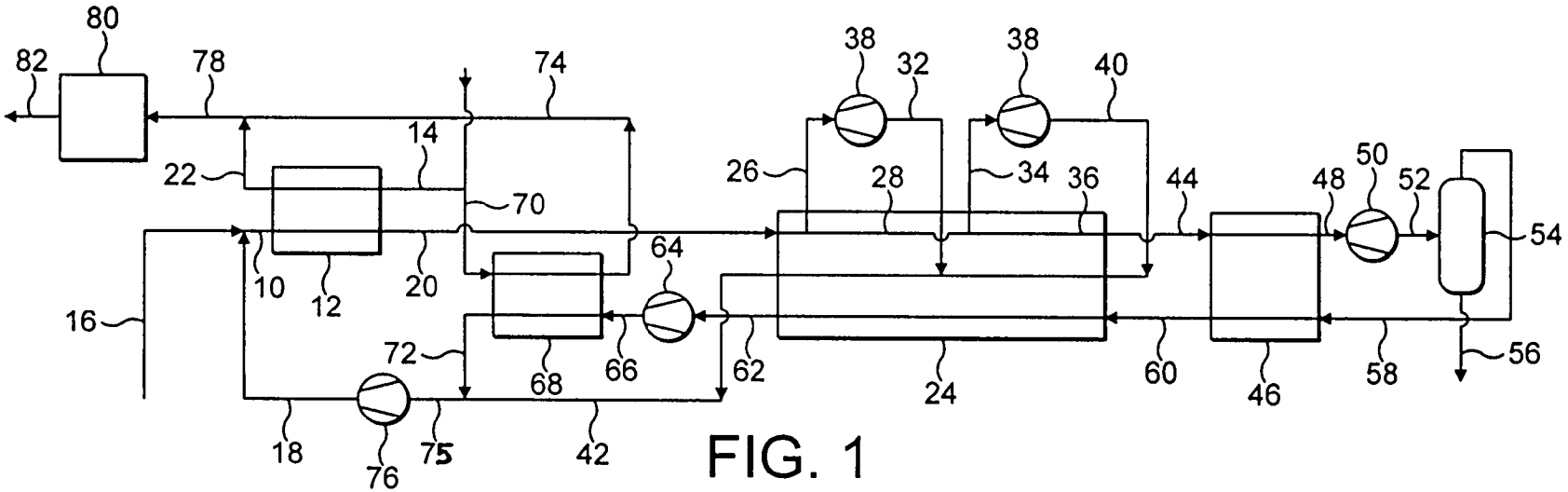
FIG. 1 is a schematic representation of an embodiment of the first aspect of the present invention.

The hydrogen liquefaction process according to the present invention comprises:

- pre-cooling hydrogen feed gas by indirect heat exchange against pressurized liquefied natural gas ("LNG") to produce pre-cooled hydrogen feed gas and pressurized natural gas;
- further cooling at least a portion of said pre-cooled hydrogen feed gas by indirect heat exchange against at least one refrigerant to produce condensable hydrogen feed gas and at least one warmed refrigerant; and
- expanding at least a portion of said condensable hydrogen feed gas to produce at least partially condensed hydrogen.

The expression "pressurized LNG" in intended to describe LNG a pressure greater than atmospheric pressure (e.g. greater than about 0.1 MPa). Preferably, the pressurized LNG is at a pressure of at least 2 MPa and, more preferably, between from about 3 to 10 MPa.

The expression "condensable hydrogen gas" is intended to describe hydrogen gas under particular temperature and pressure conditions such that expansion of the gas at that point will at least partially condense the gas.

The inventors have realized that reduction of the temperature of hydrogen feed gas to below the Joule-Thomson inversion temperature for hydrogen gas is possible by pre-cooling the hydrogen feed gas by indirect heat exchange against pressurized LNG. In the present process, this inversion temperature is usually about −150° C. In some embodiments, the pre-cooled hydrogen feed gas is at a temperature of −156° C. and a pressure of 2.5 MPa.

Typically, the total amount of pressurized LNG used in the present hydrogen liquefaction process is from about 10 to about 60 $kg_{(LNG)}$ per $kg_{(liquid\ hydrogen)}$, for example from about 27 to about 37 $kg_{(LNG)}$ per $kg_{(liquid\ hydrogen)}$.

In preferred embodiments, the hydrogen liquefaction process is integrated with an LNG facility producing pressurized LNG. In such embodiments, the process may further comprise:

- pressurizing LNG from an LNG storage facility to produce pressurized LNG; and
- using said pressurized LNG as at least a portion of the pressurized LNG used in the process. LNG from an LNG storage facility may be pumped to a pressure of from about 3 to about 10 MPa and usually to a pressure of from about 6 to about 8 MPa. It is known to pump LNG to a pressure of about 4 MPa or about 8 MPa.

The pressurized LNG is usually at a temperature of about −158° C. Not only is the pressurized LNG at a sufficiently low temperature and have sufficient refrigeration capacity to pre-cool hydrogen feed and to absorb heat of compression in the liquefaction process, but also the heating of pressurized LNG by indirect heat exchange against hydrogen reduces the amount of natural gas required for combustion to heat pressurized LNG to produce high pressure natural gas for supply to pipelines.

In preferred embodiments, the process further comprises:

- cold compressing the or at least one warmed refrigerant to produce at least one compressed refrigerant;
- cooling the or at least one compressed refrigerant to produce at least one cooled, compressed refrigerant; and
- recycling within the process the or at least one cooled, compressed refrigerant.

The expression "cold compressing" is intended to include process steps in which warmed refrigerant is compressed at a temperature below ambient temperature, for example at a cryogenic temperature, e.g. below −50° C. For example, the expression is intended to include processes where the compressor is located downstream of the cold end of the pre-cooling heat exchanger. The expression should include processes in which warmed refrigerant is compressed at an intermediate temperature, e.g. a temperature between the temperature limits of the cycle, and the heat of compression removed by a cryogenic coolant, e.g. a coolant at a temperature of below about −50° C., for example pressurized LNG at about −158° C.

The heat generated by cold compression of the or at least one warmed refrigerant may be removed using pressurized LNG. Cooling during cold compression is preferably provided by indirect heat exchange against pressurized LNG. In preferred embodiments, the or at least one compressed refrigerant is cooled by indirect heat exchange against pressurized LNG. Preferred embodiments of the process involve the use of at least one pressurized LNG inter-cooled multiple stage compressor to carry out the cold compression. All of the heat of compression can be removed in the heated pressurized LNG.

Pressurized natural gas is usually fed to supply pipelines at ambient temperature. The heated pressurized LNG produced by the present process may be too cold to be fed directly to such pipelines. Therefore, where the hydrogen liquefaction process is to be integrated with natural gas supply pipelines, the heated pressurized LNG is usually further heated to bring the temperature up to ambient before being fed to the pipeline system.

One of the advantages of preferred embodiments of the present process is that the pre-cooling step can, at least in principle, be used in combination with any of the examples of steps for further cooling pre-cooled hydrogen feed gas and for expanding condensable hydrogen gas known in the art. The following is a general description of only some of the possible embodiments.

Any suitable refrigerant(s) may be used to further cool the pre-cooled hydrogen feed gas to produce condensable hydrogen gas. Examples of suitable refrigerants include molecular hydrogen, helium, neon, molecular nitrogen and mixtures thereof. Preferably, the or at least one refrigerant comprises molecular hydrogen. In preferred embodiments, the or each of the refrigerants is molecular hydrogen.

A single refrigerant may be all that is required to provide the refrigeration duty necessary to further cool the pre-cooled hydrogen feed gas to produce condensable hydrogen gas. Alternatively, more than one refrigerant may be used to provide this refrigeration duty. In such alternative embodiments, at least one of the resultant warmed refrigerants may be cold compressed, cooled and recycled although it is preferred that each warmed refrigerant is processed in this way.

Usually, expanding at least a portion of the condensable hydrogen feed gas produces a mixture of liquid hydrogen and hydrogen vapor. In preferred embodiments, therefore, the process further comprises:

separating at least a portion of said mixture into liquid hydrogen and hydrogen vapor; and further cooling pre-cooled hydrogen feed gas by indirect heat exchange against at least a portion of said hydrogen vapor thereby producing hydrogen flash gas.

The refrigeration duty provided by the hydrogen vapor may not be sufficient to further cool the pre-cooled hydrogen feed gas to form the condensable hydrogen gas. In such cases, only a portion of the refrigeration duty required to produce condensable hydrogen gas from said pre-cooled hydrogen feed gas is provided by indirect heat exchange against at least a portion of said hydrogen vapor and at least one further refrigerant would be required.

Preferably, at least a portion of the hydrogen flash gas is cold compressed to produce compressed hydrogen flash gas and then at least a portion of said compressed hydrogen flash gas is cooled by indirect heat exchange against pressurized LNG to produce cooled, compressed hydrogen flash gas and pressurized natural gas.

Alternatively, the process may further comprise:

cooling pre-cooled hydrogen feed gas by indirect heat exchange against said the or at least one refrigerant to produce cooled hydrogen feed gas;

dividing said cooled hydrogen feed gas into a first portion and a second portion;

expanding said first portion to produce expanded hydrogen gas; and further cooling pre-cooled hydrogen feed gas by indirect heat exchange against at least a portion of said expanded hydrogen gas.

Such processes may further comprise:

cooling said second portion of cooled hydrogen feed gas by indirect heat exchange against said the or at least one refrigerant to produce further cooled hydrogen feed gas;

dividing said further cooled hydrogen feed gas into a first part and a second part;

expanding said first part to produce expanded hydrogen gas; and further cooling pre-cooled hydrogen feed gas by indirect heat exchange against at least a portion of said expanded hydrogen gas.

These processes in which hydrogen gas is expanded to provide refrigeration may not provide sufficient refrigeration duty to further cool the pre-cooled hydrogen feed gas to form the condensable hydrogen gas. In such cases, only a portion of the refrigeration duty required to produce condensable hydrogen gas from said pre-cooled hydrogen feed gas is provided by indirect heat exchange against said expanded hydrogen gas.

These processes may comprise cold compressing at least a portion of the resultant warmed expanded hydrogen gas to produce compressed hydrogen gas and cooling at least a portion of said compressed hydrogen gas by indirect heat exchange against pressurized LNG to produce cooled, compressed hydrogen gas and pressurized natural gas.

In embodiments in which neither the hydrogen flash gas nor the expanded hydrogen gas provide sufficient refrigeration duty to further cool the pre-cooled hydrogen feed gas to form the condensable hydrogen gas Individually, both hydrogen flash gas and expanded hydrogen gas may be used together to provide the necessary refrigeration duty. In such embodiments, the process may further comprise;

combining said cooled, compressed hydrogen flash gas with said expanded hydrogen gas to produce combined hydrogen gas;

cold compressing at least a portion of said combined hydrogen gas to produce compressed combined hydrogen gas; and cooling at least a portion of said compressed combined hydrogen gas by indirect heat exchange against pressurized LNG to produce cooled, compressed combined hydrogen gas and pressurized natural gas.

A feature of preferred embodiments of the present invention is that the temperature of pre-cooled hydrogen feed gas entering the main heat exchanger of the hydrogen liquefier is about the same as the temperature of hydrogen flash gas and of warmed expanded hydrogen gas leaving the main heat exchanger, e.g. about −156° C.

In preferred embodiments, the hydrogen feed gas comprises hydrogen gas recycled from downstream within the liquefaction process. In certain embodiments, the hydrogen feed gas comprises at least one stream of fresh hydrogen gas combined with recycled hydrogen gas. Therefore, the recycled hydrogen gas will be at the same pressure as the fresh hydrogen gas. In other embodiments, the hydrogen feed gas consists of at least one stream of fresh hydrogen gas. In these other embodiments, the pressure of the or at least one stream of fresh hydrogen gas may be the same or different from the pressure of the or at least one refrigerant. For example, the or at least one refrigerant may be at a pressure of from about 1.5 to about 3 MPa, e.g. 2.5 MPa, and the hydrogen feed gas may be at a pressure either of from about 1.5 to about 3 MPa, e.g. 2.5 MPa, or of from about 8 to about 12 MPa, e.g. 10 MPa.

The temperature of the hydrogen feed gas is usually from about 15° C. to about 40° C., for example about 30° C. or about ambient temperature, e.g. from about 15 to about 20° C. The pressure of the hydrogen feed gas is usually between about 0.1 to about 15 MPa and is preferably either in the range of from about 1.5 to about 3 MPa, e.g. about 2.5 MPa, or from about 8 to about 12 MPa, e.g. about 10 MPa.

Suitable catalysts for the conversion of ortho hydrogen to para hydrogen will usually be provided at multiple temperature levels in the process including the final hydrogen liquefaction temperature. The liquefaction process may be designed so that substantially all of the liquid hydrogen production is in the para form. The heat exchange system may be designed so that, at each ortho-para conversion temperature level, all the heat liberated in the ortho-para conversion is absorbed by the warming refrigerant streams.

Carbonaceous or hydrocarbon-containing fuel may be reacted with steam and/or an oxidant gas comprising molecular oxygen to produce carbon monoxide and hydrogen gas in catalytic or non-catalytic processes. This hydrogen gas preferably forms at least a portion of the hydrogen feed gas. The hydrocarbon-containing fuel may be reacted with steam in a steam-methane reformer, with air (or oxygen gas) in a partial oxidation reactor or with steam and air (or oxygen gas) in an autothermal reformer. The hydrogen gas produced by such a process may be stored and, if required, liquefied at a later date. Alternatively, the process to produce the hydrogen gas may be integrated with the present invention with the hydrogen gas being fed directly, after purification, into the present process.

Steam methane reformers and autothermal reformers may produce hydrogen at a pressure of from about 1.5 to about 3 MPa, e.g. about 2.5 MPa. A Partial Oxidation Enhanced Heat Transfer Reformer (POX EHTR) may produce hydrogen gas at a pressure of from about 8 to about 12 MPa, e.g. about 10 MPa. Such a POX EHTR is described in EP-A-1197471 published on 17 Apr. 2002, the disclosure of which is incorporated herein by reference.

The hydrocarbon containing fuel is usually natural gas which would be readily available if the liquefaction process is integrated with an LNG terminal. In such embodiments, the hydrocarbon-containing fuel may be at least a portion of the natural gas produced by indirect heat exchange against the hydrogen gas feed.

Hydrogen gas is usually purified to remove impurities that might solidify in the hydrogen liquefier before being pre-cooled. After pre-cooling, the pre-cooled hydrogen gas may be further purified as required.

A particularly preferred embodiment is a process substantially as hereinbefore described with reference to the accompanying drawing.

In a second aspect of the present invention, there is provided use of hydrogen gas to heat pressurized LNG by indirect heat exchange.

In a third aspect of the present invention, there is provided use of pressurized LNG as the cooling fluid in a hydrogen gas compressor.

In a fourth aspect of the present invention, there is provided apparatus for liquefying hydrogen according to the process defined in the first aspect comprising:

- heat exchange means for pre-cooling hydrogen feed gas by indirect heat exchange against pressurized LNG to produce pre-cooled hydrogen feed gas;
- heat exchange means for further cooling pre-cooled hydrogen feed gas by indirect heat exchange against at least one refrigerant to produce condensable hydrogen feed gas and at least one warmed refrigerant; and
- expansion means for expanding condensable hydrogen feed gas to produce at least partially condensed hydrogen.

The apparatus may be adapted and/or constructed such as to enable operation of any of the embodiments of the process described above.

In preferred embodiments, the apparatus further comprises at least one source of pressurized LNG, for example, the or at least one pump in an LNG storage and distribution facility.

One of the advantages of preferred embodiments of the present apparatus is that the heat exchange means for the pre-cooling step can, at least in principle, be used in combination with apparatus for further cooling pre-cooled hydrogen feed gas and for expanding condensable hydrogen gas known in the art. The following is a general description of some of the possible embodiments.

The apparatus may further comprise:

- cold compression means for cold compressing the or at least one warmed refrigerant to produce at least one compressed refrigerant;
- heat exchange means for cooling the or at least one compressed refrigerant to produce at least one cooled, compressed refrigerant; and
- means for recycling the or at least one cooled, compressed refrigerant within the process.

Where the or at least one refrigerant is molecular hydrogen, the apparatus preferably further comprising means for recycling hydrogen gas refrigerant to form part of said hydrogen feed gas.

In embodiments where the expansion means produces a mixture of liquid hydrogen and hydrogen vapor, the apparatus preferably further comprising:

- separating means for separating at least a portion of said mixture into liquid hydrogen and hydrogen vapor; and
- heat exchange means for further cooling pre-cooled hydrogen feed gas by indirect heat exchange against at least a portion of hydrogen vapor thereby producing hydrogen flash gas. In these embodiments, the apparatus may further comprise:
- cold compression means for cold compressing at least a portion of said hydrogen flash gas to produce compressed hydrogen flash gas; and
- heat exchange means for cooling at least a portion of said compressed hydrogen flash gas by indirect heat exchange against pressurized LNG to produce cooled, compressed hydrogen flash gas and pressurized natural gas.

At least one of the heat exchange means is preferably a multi-stream plate fin heat exchanger. The pre-coolers are preferably high pressure aluminium plate-fin heat exchangers.

The apparatus may further comprise heating means for heating at least a portion of said pressurized natural gas to about ambient temperature before said natural gas is fed to a supply pipeline. A temperature controlling means may be required on the heating means to control the natural gas discharge temperature. Flow control means such as a valve is usually used downstream of LNG terminal heaters to control the flow of pressurized LNG from the terminal to the hydrogen liquefier and to provide any necessary pressure drop in the process for the LNG flow.

The cold compression means is preferably at least one multiple stage compressor inter-cooled with pressurized LNG.

A preferred embodiment is apparatus substantially as hereinbefore described with reference to the accompanying drawing.

The following is a description, by way of example only and with reference to FIG. 1, of a presently preferred embodiment of the invention.

A stream 10 of hydrogen feed gas is fed, at about 2.5 MPa and 30° C., to the inlet of a plate-fin heat exchanger 12 where it is pre-cooled against a stream 14 of high pressure LNG which may be taken from the discharge of the LNG pumps (not shown) in an LNG terminal (not shown) which supplies natural gas at high pressure to pipeline systems (not shown). The high pressure LNG is at a temperature of about −158° C. and a pressure of about 40 MPa.

The hydrogen feed gas stream 10 is formed from the combination of a stream 16 of fresh hydrogen gas which may be produced in an integrated hydrogen gas production process (not shown), and a stream 18 of compressed recycled hydrogen gas. The fresh hydrogen gas has been purified in a purification system (not shown) to remove impurities that might solidify during the hydrogen liquefaction process.

The hydrogen feed gas is pre-cooled to produce a stream 20 of pre-cooled hydrogen feed gas at about 2.5 MPa and about −156° C. and the pressurized LNG stream 14 is heated to produce a stream 22 of pressurized natural gas.

The pre-cooled hydrogen feed gas stream 20 is further cooled in heat exchanger 24 to about −163° C. at which point it is divided into a first stream 26 and a second stream 28. The first stream 26 is expanded in an expander 30 to produce a stream 32 of expanded hydrogen gas at a pressure of about 0.25 MPa and a temperature of about −221° C. The expander 30 discharge stream 32 is sent back through the heat exchanger 24 where it provides a portion of the refrigeration duty required to form condensable hydrogen gas.

The second stream 28 is further cooled in heat exchanger 24 to a temperature of about −208° C. at which point it is divided into a first part 34 and a second part 36. The first part 34 is expanded in an expander 38 to produce an expanded hydrogen gas stream 40 at a pressure of about 0.25 MPa and a temperature of about −244° C. The expander 38 discharge stream 40 is sent back through exchanger 24 as a cooling stream where it combines with the expander 30 discharge stream 32 and provides a portion of the refrigeration duty required to form condensable hydrogen gas. The combined expanded hydrogen gas stream 42 leaves the heat exchanger 24 at a temperature of about −158° C. The second part 36 of the 2.5 MPa hydrogen gas is further cooled and leaves the heat exchanger 24 as stream 44. Hydrogen gas stream 44 is further cooled in flash gas cooler 46 to produce a stream 48 of condensable hydrogen gas at a temperature of about −240° C. and a pressure of about 2.5 MPa.

Stream 48 of condensable hydrogen gas is expanded in an expander 50 to produced a two-phase stream 52 at a pressure of about 0.1 MPa and a temperature of about −253° C. containing about 31% hydrogen flash gas and about 69% liquid hydrogen.

Due to the physical properties of hydrogen gas, expanders 30, 38 and 50 could consist of either reciprocating engines or multiple wheel centrifugal turbines arranged in series, in each case with means to absorb the power generated in the expansion, such as electrical generators.

The approximately 25% ortho/75% para hydrogen which exists at ambient temperatures is converted to the near 100% para hydrogen which is the equilibrium state at liquid hydrogen temperatures corresponding to near atmospheric pressure liquid hydrogen. The heat liberated in this catalytic conversion process is provided as part of the refrigeration load on the liquefier. The catalyst in this embodiment could be arranged as a number of vessels (not shown) at different temperature levels. The hydrogen gas would be taken from the heat exchanger 24 or heat exchanger 46 or stream 52, and passed through the catalyst vessels (not shown) where it reaches equilibrium and rises in temperature (since the conversion of ortho to para hydrogen is exothermic) and would then be returned to the heat exchanger 24 or flash gas cooler 46 at a higher temperature level and resumes its cooling towards the liquid state.

Alternatively, the catalyst could be provided on the walls of the hydrogen feed passages in the heat exchanger 24, for example by deposition or supported on an insert for the passages, so that the conversion and heat removal are a continuous process as the hydrogen gas is cooled.

The two-phase stream 52 is fed to a separator 54 where it is separated into liquid hydrogen and hydrogen flash gas. A stream 56 of liquid hydrogen is removed and sent for storage (not shown). A stream 58 of hydrogen flash gas is passed back through the flash gas cooler 46 where it provides a portion of the refrigeration duty to form condensable hydrogen gas and leaves the heat exchanger 46 as stream 60. Stream 60 then passes back through the heat exchanger 24 where it provides a portion of the refrigeration duty required to further cool the pre-cooled hydrogen gas in streams 20, 28 and 36.

A stream 62 of warmed hydrogen flash gas is then fed to a compressor 64 where it is cold compressed to from a stream 66 of compressed hydrogen gas at a pressure of about 0.25 MPa which is fed to an LNG cooler 68 where it is cooled by indirect heat exchange against a pressurized LNG stream 70 to produce a stream 72 of cooled compressed hydrogen flash gas and a stream 74 of heated natural gas. The cooled stream 72 is mixed with stream 42 of recycled hydrogen gas leaving the liquefier heat exchanger 24. The combined recycle and flash gas stream 75 is fed to a compressor 76 where it is compressed to form the stream 18 of recycled hydrogen gas at a pressure of about 2.5 MPa. The compressor 76 is a two casing, twelve wheel (six per casing) centrifugal compressor. The hydrogen gas leaving the first casing is at about −105° C. and is then cooled to about −156° C. using pressurized LNG before entering the second casing.

Streams 22 and 74 of warmed natural gas are combined and the combined stream 78 is heated in a heater 80 to produce a stream 82 of pressurized natural gas at about ambient temperature.

The power consumption of the above process is about 2.9 $kWh/kg_{(liquid\ para\ hydrogen)}$ at about 0.1 MPa pressure compared to about 11 kWh/kg for a current nitrogen recycle cooled process. Further power reduction is possible if the feed hydrogen stream 10 is at a pressure of about 10 MPa and passes straight through the heat exchangers 24 and 46 before entering the expander 50. The liquefier recycle circuit is then operated as a separate recycle system 18 at a pressure of about 2.5 MPa entering heat exchanger 24 and then passing through expanders 30 and 38 before returning at a pressure of 0.25 MPa to the recycle compressor 76 as combined stream 74 composed of stream 42 and the flash gas stream 72. The flash gas portion of stream 40 leaves the cold end of heat exchanger 24 and is further cooled against the 0.1 MPa flash gas from separator 54 and expanded in a fourth expander (not shown) to a pressure of about 0.105 bar (i.e. about 0.01 MPa) producing a second liquid vapor mixture which is separated in 54.

The compressors 64 and 76 can optionally be multistage intercooled machines having intercoolers cooled by countercurrent flow of pressurized LNG, or they can be adiabatic machines as described in this example with a single LNG cooled aftercooler. The compressors 64 and 76 can be built as multiwheel centrifugal or reciprocating machines.

EXAMPLE

As mentioned above, hydrogen gas can be produced at a pressure of from about 1.5 to about 3 MPa, e.g. about 2.5 MPa, or from about 8 to about 12 MPa, e.g. about 10 MPa. Therefore, two different liquefier pressures were investigated using computer simulation, with three different process routes available:

- Liquefying hydrogen produced at a pressure of 2.5 MPa without prior compression;
- Compressing hydrogen (produced at a pressure of 2.5 MPa) to 10 MPa and liquefying the compressed hydrogen; and
- Liquefying hydrogen produced at a pressure of 10 MPa without prior compression.

Despite the different operating pressures, the two liquefiers function in essentially the same way. The hydrogen feed gas is pre-cooled by indirect heat exchange against pressurized LNG and the pre-cooled hydrogen feed gas enters the liquefier where it is further cooled by indirect heat exchange against a refrigerant produced from expanding part of the pre-cooled hydrogen feed gas through expanders operating at two different temperature levels. The expanded hydrogen gas refrigerant together with flash gas then further cools the pre-cooled hydrogen feed gas to approximately −240° C. (33 K) to produce condensable hydrogen gas. The condensable hydrogen gas is then expanded through a super-critical expander down to almost atmospheric pressure thereby producing a hydrogen liquid/vapor mixture. The liquid hydrogen is then separated and sent to storage, with the vapor being returned as a cold stream into the liquefier heat exchanger where it becomes flash gas. The flash gas upon exiting the liquefier heat exchanger is compressed, mixed with hydrogen that has passed through the refrigeration expanders. The gaseous hydrogen mixture is then further compressed and recycled back into the process.

The flash gas compression and the hydrogen recycle compressor both have pressurized LNG cooling rather than cooling water.

Ambient gaseous hydrogen exists as 75% ortho and 25% para whereas liquid hydrogen is almost 100% para. Ortho-para converters are located throughout the liquefier. These converters bring the hydrogen to its equilibrium position. If the ortho hydrogen is not converted to para hydrogen, the liquid hydrogen would slowly evaporate off in the tank as heat is released as the hydrogen moves towards equilibrium. The exothermic heat of conversion of ortho to para hydrogen is removed using the hydrogen plant refrigeration system.

Table 1 highlights the results produced from the three different process routes. The table indicates the amount of pressurized LNG that is required for pre-cooling and the power needed to liquefy the hydrogen (the results of using the LNG for interstage cooling on the recycle compressor are also shown for the 10 MPa case).

TABLE 1

| Process Route | 2.5 MPa $H_2$(g) to $H_2$(l) | 2.5 MPa $H_2$(g) to 10 MPa $H_2$(g) to $H_2$(l) | 10 MPa $H_2$(g) to $H_2$(l) | 10 MPa $H_2$(g) to $H_2$(l) (Interstage)* |
|---|---|---|---|---|
| Energy KWh/kg$_{(liquid\ H2)}$ | 3.19 | 2.91 | 2.59 | 2.01 |
| LNG Kg$_{(LNG)}$/ kg$_{(liquid\ H2)}$ | 26.8 | 25.8 | 22.9 | 37.1 |
| Energy Saving** | 71.0% | 73.5% | 76.4% | 81.7% |

*This uses LNG to provide interstage cooling on the main recycle compressor thereby reducing power consumption and increasing the LNG requirement

**Based on current 11 kWh/kg$_{(liquid\ H2)}$

The results clearly show that, by using LNG as a pre-coolant, considerable energy savings over current liquefaction methods are possible. At present, most LNG terminals use pressurized LNG heaters having a water bath with submerged burners utilizing the natural gas as a fuel to vaporize the remaining LNG. Typically, between 1 to 2% of the LNG is consumed in this process and, therefore, vaporization of the LNG in a process integrated with a hydrogen liquefier would be of significant benefit to the LNG terminal.

Based on the capacity of the current European LNG terminals, the quantity of liquid hydrogen that could potentially be produced for vehicle fuel using LNG refrigeration would be sufficient for many millions of vehicles. This means that the cost savings which the present invention provides can be applied for facilitating the use of liquid hydrogen as the preferred hydrogen supply option in the future for vehicle refueling.

Natural gas terminal facilities have such a large capacity that the refrigeration available from LNG can be used not only to pre-cool hydrogen gas but also as a cooling fluid in hydrogen liquefier compressors so that these will also operate at temperatures low enough to ensure that all feed streams to the hydrogen liquefier are below the Joules-Thompson inversion temperature. Pre-cooling the feed gas to the hydrogen liquefier compressor and the flash gas compressors also greatly reduces the power consumptions and compressor size.

The inventors have shown that operation of preferred hydrogen liquefaction processes within the scope of the present invention reduces power consumption to from about 2 to about 3.2 kWh/kg$_{(liquid\ hydrogen)}$ due to the refrigeration capacity of LNG. Such a reduction represents a saving in energy of from about 71% to about 82%. On the basis of the cost estimate for liquid hydrogen distribution provided in the recent report by the US National Renewable Energy Laboratory (discussed above), such a saving in energy could reduce the distributed cost of liquid hydrogen by over 10% to about $3.28/kg (based on a power consumption of 2.59 kWh/kg calculated for the 10 MPa LNG inter-cooled liquefaction cycle—see example). This figure takes into account the total cost for the power consumed in hydrogen production using a steam methane reformer and total cost for distribution and dispensing at the filling station. A further reduction would be observed if a partial oxidation enhanced heat transfer reformer is used (see below).

Throughout the specification, the term "means" in the context of means for carrying out a function, is intended to refer to at least one device adapted and/or constructed to carry out that function.

It will be appreciated that the invention is not restricted to the details described above with reference to the preferred embodiments but that numerous modifications and variations can be made without departing from the spirit or scope of the invention as defined by the following claims.

The invention claimed is:

1. A process for liquefying hydrogen gas comprising:

pre-cooling hydrogen feed gas by indirect heat exchange against pressurized liquefied natural gas ("LNG") to produce pre-cooled hydrogen feed gas and heated pressurized LNG, wherein the pressurized LNG has a critical pressure and the pressure of the pressurized LNG is at or above the critical pressure;

further cooling at least a portion of said pre-cooled hydrogen feed gas by indirect heat exchange against at least one refrigerant to produce condensable hydrogen feed gas and at least one warmed refrigerant; and expanding at least a portion of said condensable hydrogen feed gas to produce at least partially condensed hydrogen.

2. The process for liquefying hydrogen gas according to claim 1, wherein expanding at least a portion of said condensable hydrogen feed gas produces a mixture of liquid hydrogen and hydrogen vapor, said process further comprising:

separating at least a portion of said mixture into liquid hydrogen and hydrogen vapor; and further cooling pre-cooled hydrogen feed gas by indirect heat exchange against at least a portion of said hydrogen vapor thereby producing hydrogen flash gas as at least one warmed refrigerant.

3. The process according to claim 2, comprising:

cold compressing at least a portion of said hydrogen flash gas to produce compressed hydrogen flash gas; and cooling at least a portion of said compressed hydrogen flash gas by indirect heat exchange against pressurized LNG to produce cooled, compressed hydrogen flash gas and heated pressurized LNG.

4. The process according to claim 1, comprising:

cooling pre-cooled hydrogen feed gas by indirect heat exchange against said the at least one refrigerant to produce cooled hydrogen feed gas;

dividing said cooled hydrogen feed gas into a first portion and a second portion;

expanding said first portion to produce expanded hydrogen gas; and further cooling pre-cooled hydrogen feed gas by indirect heat exchange against at least a portion of said expanded hydrogen gas to produce warmed expanded hydrogen gas as at least one warmed refrigerant.

5. The process according to claim 4, further comprising:

cooling said second portion of cooled hydrogen feed gas by indirect heat exchange against said the or at least one refrigerant to produce further cooled hydrogen feed gas;

dividing said further cooled hydrogen feed gas into a first part and a second part;

expanding said first part to produce expanded hydrogen gas; and further cooling pre-cooled hydrogen feed gas by indirect heat exchange against at least a portion of said expanded hydrogen gas to produce warmed expanded hydrogen gas as at least one warmed refrigerant.

6. The process according to claim 4, wherein only a portion of the refrigeration duty required to produce condensable hydrogen gas from said pre-cooled hydrogen feed gas is provided by indirect heat exchange against said expanded hydrogen gas.

7. The process according to claim 4, comprising:

cold compressing at least a portion of the resultant warmed expanded hydrogen gas to produce compressed hydrogen gas; and cooling at least a portion of said compressed hydrogen gas by indirect heat exchange against pressurized LNG to produce cooled, compressed hydrogen gas and heated pressurized LNG.

8. The process according to claim 3, further comprising;

combining said cooled, compressed hydrogen flash gas with said expanded hydrogen gas to produce combined hydrogen gas;

cold compressing at least a portion of said combined hydrogen gas to produce compressed combined hydrogen gas; and cooling at least a portion of said compressed combined hydrogen gas by indirect heat exchange against pressurized LNG to produce cooled, compressed combined hydrogen gas and heated pressurized LNG.

9. The process according to claim 2, wherein the temperature of said pre-cooled hydrogen feed gas is about the same as the temperature of the hydrogen flash gas.

10. The process according to claim 9, wherein said temperature is from About −158° C. to about −140° C.

11. The process according to claim 9, wherein said temperature is about −156° C.

12. The process according to claim 1, comprising feeding at least a portion of said heated pressurized LNG into natural gas supply pipelines for distribution to industry and homes after heating to ambient temperature.

13. The process according to claim 1, wherein the pressure of the pressurized LNG is up to 10 MPa.

14. The process according to claim 1, wherein the pressure of the pressurized LNG is from about 6 MPa to about 8 MPa.

15. The process according to claim 4, or claim 5, wherein the temperature of said pre-cooled hydrogen feed gas is about the same as the temperature of the warmed expanded hydrogen gas.

16. The process according to claim 15, wherein said temperature is from about −158° C. to about −140° C.

17. The process according to claim 16, wherein said temperature is about −156° C.

18. The process according to claim 3 or claim 7 wherein cooling during cold compression is provided by indirect heat exchange against pressurized LNG.

19. The process according to claim 18, using at least one pressurized LNG inter-cooled multiple stage compressor to carry out the cold compression.

* * * * *